US010723608B2

(12) United States Patent
Trench et al.

(10) Patent No.: US 10,723,608 B2
(45) Date of Patent: Jul. 28, 2020

(54) SYSTEMS, METHODS, AND APPARATUS FOR PULL-TAB SEAL REMOVAL

(71) Applicants: William H. Trench, South Salem, NY (US); Peter Trench, South Salem, NY (US)

(72) Inventors: William H. Trench, South Salem, NY (US); Peter Trench, South Salem, NY (US)

( * ) Notice: Subject to any disclaimer, the term of this patent is extended or adjusted under 35 U.S.C. 154(b) by 212 days.

(21) Appl. No.: 15/981,196

(22) Filed: May 16, 2018

(65) Prior Publication Data

US 2018/0334371 A1 Nov. 22, 2018

Related U.S. Application Data

(60) Provisional application No. 62/506,826, filed on May 16, 2017.

(51) Int. Cl.
*B67B 7/00* (2006.01)

(52) U.S. Cl.
CPC ..... *B67B 7/24* (2013.01)

(58) Field of Classification Search
CPC .... B67B 7/24; B67B 7/26; B67B 7/28; B67B 7/12
See application file for complete search history.

(56) References Cited

U.S. PATENT DOCUMENTS 1,347,410 A * 7/1920 Ryan ..... B67B 7/12 215/226
1,518,222 A * 12/1924 Sather ..... B67B 7/12 81/3.29
1,640,382 A * 8/1927 Sumner ..... B67B 7/12 81/3.49
1,657,782 A * 1/1928 Berg ..... B67B 7/12 141/330
3,581,605 A * 6/1971 Taylor ..... B67B 7/12 81/3.49

* cited by examiner

*Primary Examiner* — David B. Thomas
(74) *Attorney, Agent, or Firm* — Carson C. K. Fincham; Fincham Downs, LLC

(57) ABSTRACT

Systems, methods, and apparatus for pull-tab seal removal are provided. An extraction tool for removal of integrated pull-tab seals from containers may comprise a cover slidably coupled to a body portion in which an extraction shaft and/or a seal gap separator operate to remove the seal while requiring less dexterity and/or less applied force than would otherwise be required.

12 Claims, 9 Drawing Sheets

SYSTEMS, METHODS, AND APPARATUS FOR PULL-TAB SEAL REMOVAL

CROSS-REFERENCE TO RELATED APPLICATIONS

The present application is a non-provisional of, and claims benefit and priority under 35 U.S.C. § 119(e) to U.S. Provisional Patent Application No. 62/506,826 filed on May 16, 2017 and titled "Device for extracting the plastic disk seals from the spouts of paper cartons", the entirety of which is hereby incorporated by reference herein.

BACKGROUND

Many packaging containers filled with various fluids are sealed with a variety of types of leak-proof, freshness (e.g., hermetic), tamper-resistant, and/or tamper-evident devices. One common type of sealing method for paper-product cartons filled with diary, juice, and/or other liquids employs a plastic spout having an integral seal with a pull-tab (and/or ring). While such integral pull-tab or pull-ring seals provide advantages over other sealing systems, they are subject to various deficiencies.

BRIEF DESCRIPTION OF THE DRAWINGS

An understanding of embodiments described herein and many of the attendant advantages thereof may be readily obtained by reference to the following detailed description when considered with the accompanying drawings, wherein.

DETAILED DESCRIPTION

I. Introduction

Figure 1A:
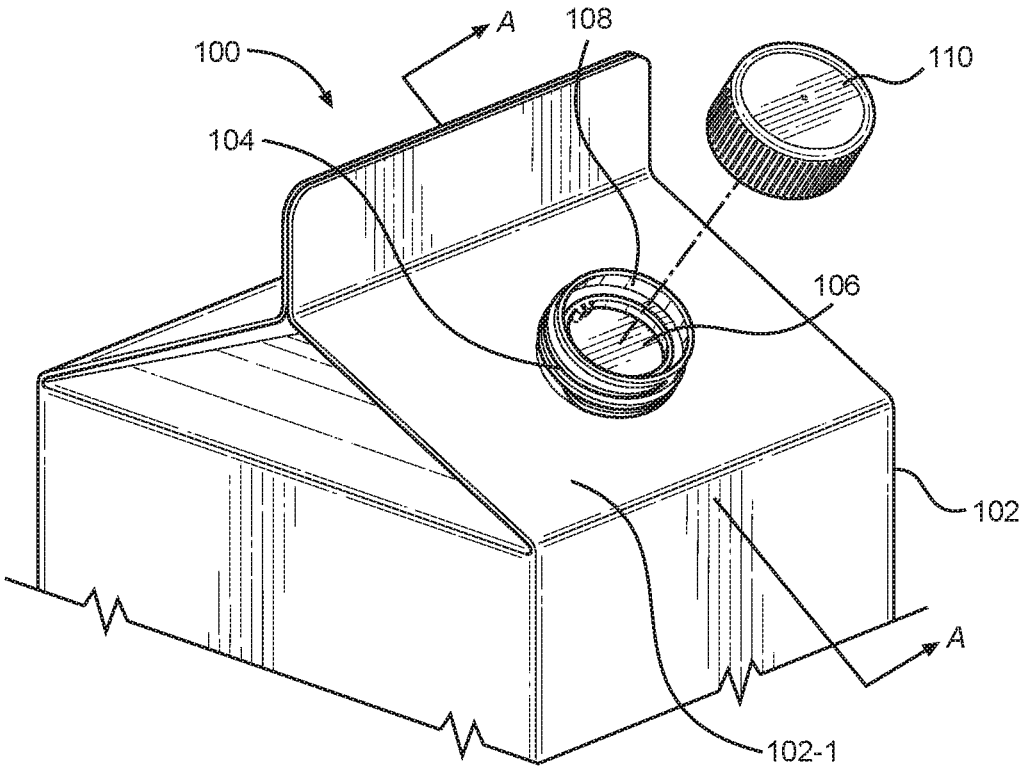
FIG. 1A PRIOR ART
FIG. 1A, FIG. 1B, and FIG. 1C are perspective and cross-sectional views of a prior art pull-tab seal system.
Figure 1B:
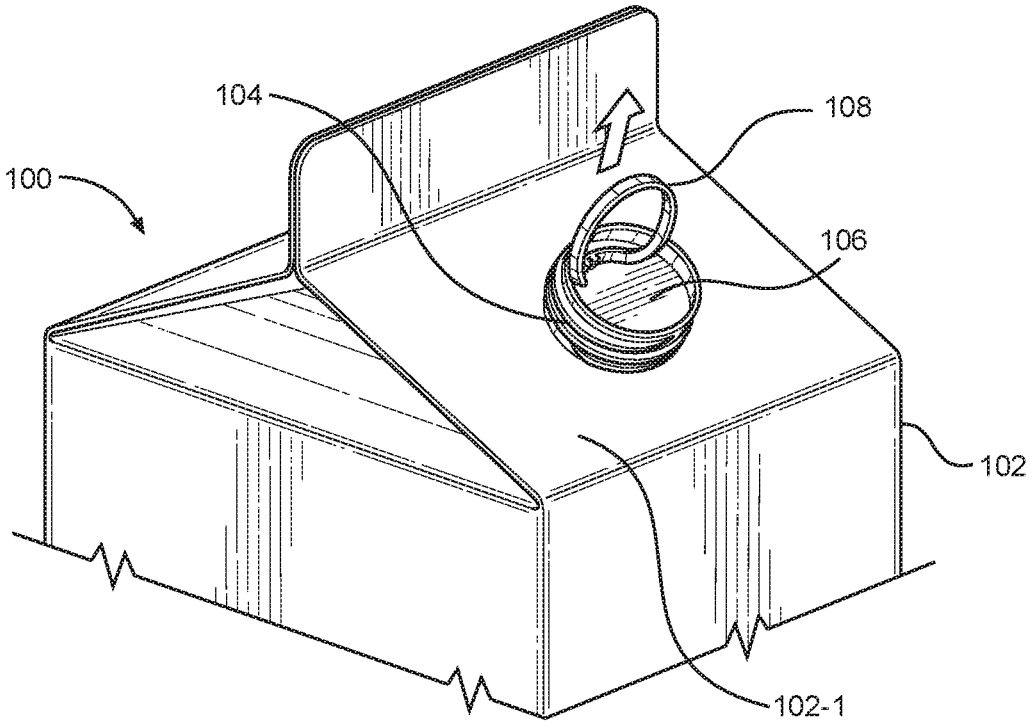
FIG. 1B PRIOR ART
Figure 1C:
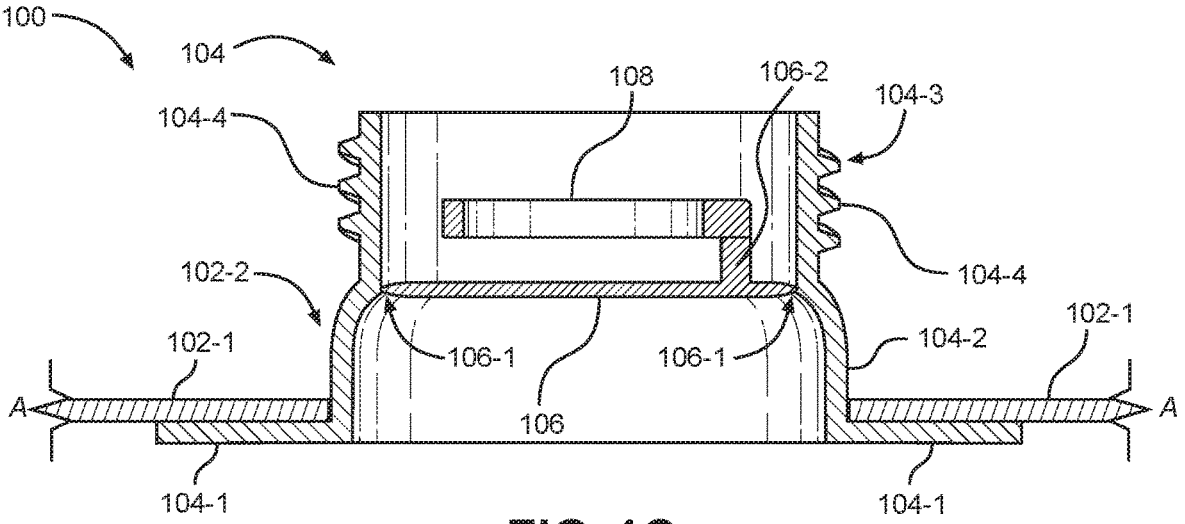
FIG. 1C PRIOR ART

Embodiments herein comprise systems, methods, and apparatus for pull-tab seal removal and/or extraction that solve some or all of the deficiencies of the prior art (e.g., the prior art system 100 of FIG. 1A, FIG. 1B, and/or FIG. 1C herein). A pull-tab seal removal/extraction tool as described herein, for example, may permit a user that otherwise encounters difficulty in opening pull-tab seal style systems to quickly and painlessly remove such seals with confidence and ease.

According to some embodiments, a tool for extracting a seal from a container may comprise (i) a body portion comprising a foot at a first end and defining an extraction socket having dimensions that permit the extraction socket to enshroud a spout of the container, (ii) an extraction shaft disposed within the extraction socket, the extraction shaft comprising a piercing element, and (iii) a cover coupled to engage with the extraction shaft and being slidably coupled to the body portion and selectively moveable between (1) a first position wherein the extraction shaft is engaged to a retracted position within the extraction socket, and (2) a second position wherein the extraction shaft is engaged to a seal penetration position within the extraction socket. In some embodiments, the cover may be ergonomically shaped and/or sized to allow those with disabilities (e.g., arthritis) to more easily extract a pull-tab style seal, e.g., as compared to prior art pull-tab seal systems.

II. Prior Art Pull-Tab Seal System

Referring initially to FIG. 1A, FIG. 1B, and FIG. 1C, for example, perspective and cross-sectional views of a prior art pull-tab seal system 100 are depicted. The system 100 generally includes, for example, a container 102 (e.g., a paper-product carton) having a dispensing (e.g., pouring) surface 102-1 through which a dispensing hole 102-2 (e.g., a pour hole) is disposed. Coupled to the dispensing surface 102-1 is a spout 104. The spout 104 may include, for example, a sealing flange 104-1 coupled about a perimeter of the dispensing hole 102-2. As shown in FIG. 1C, the sealing flange 104-1 may be coupled (e.g., glued or fused) to an underside of the dispensing surface 102-1 such that a riser 104-2 of the spout 104 projects through the dispensing hole 102-2.

In some cases, a neck 104-3 of the spout may extend from the riser 104-2 and may include threads 104-4 (e.g., external threads). The threads 104-4 may sometimes be alternatively or additionally disposed on the riser 104-2 or in some cases the riser 104-2 and the neck 104-3 may be incorporated into a single feature that projects from the container 102. In either case, a seal 106 (e.g., an integrated plastic disc) is typically disposed within the spout 104, e.g., to prevent fluid/liquid from exiting the container 102 during shipping and storage of the container 102. The seal 106 generally includes a seal groove 106-1 disposed around a circumference of the seal 106 at a site of coupling to the interior of the spout 104 (in some cases, at an interior juncture of the riser 104-2 and the neck 104-3, as depicted in FIG. 1C). The seal groove 106-1 provides, for example, an area of decreased cross-section of the seal 106 that may be selectively punctured, perforated, separated, and/or pulled from the spout 104 (e.g., more easily than compromising the seal 106 at other areas with greater cross-section) to permit selective and/or tamper-evident access to the fluid/liquid within the container 102.

In common usage, the seal 106 includes an integral tab 106-2 (e.g., a "pull-tab") disposed eccentrically on one side of the seal 106 and extending outwardly (e.g., axially outward and/or upward) from the container 102. This tab 106-2 may, in some cases, be pulled (by a user; not shown) outwardly causing stress on the seal groove 106-1, particularly at an area near the tab 106-2, causing the seal 106 to separate from the spout 104 at the seal groove 106-1 (or at least at a portion thereof). Continued pulling of the tab 106-2 may cause additional areas of the seal groove 106-1 to separate until the entire seal 106 is completely disconnected from the spout 104. In many cases, the tab 106-2 is coupled to a pull-ring 108 to facilitate user engagement with the tab 106-2.

As shown in FIG. 1C, the pull-ring 108 and the tab 106-2 may be sized to fit within the spout 104 (or the neck 104-3 thereof) such that a cap 110 may be removably secured to the spout 104. The cap 110 may, for example, comprise threads (internal threads; not shown) arranged to mate with the threads 104-4 of the spout 104. In practice, the cap 110 may be removed from the spout 104 by a typical unscrewing (e.g., counter-clockwise rotational) action and the pull-ring 108 may be rotated or flipped upward as depicted in FIG. 1B, such that it may be more easily grasped (typically by the user wrapping a finger through the pull-ring 108). Once lifted or rotated upward out from the spout 104, the pull-ring 108 may be pulled outward, e.g., in accordance with the arrow shown in FIG. 1B, to transfer outward/axial force from the pull-ring 108, through the tab 106-2, and to the seal 106. The outward axial force applied to the seal 106 causes the seal 106 to separate from the spout 104 along the seal groove 106-1.

Unfortunately, the prior art system 100 suffers various deficiencies. While the integral and tamper-evident spout 104 offers an inexpensive and convenient option for sealing cartons such as the container 102, for example, it requires a good deal of dexterity on the part of the user and can fail under the stresses required to separate the seal 106 utilizing the tab 106-2 and/or the pull-ring 108. Users with short and/or thick fingers may have difficulty grasping the tab 106-2 within the spout 104 and/or may not be able to latch onto or easily grasp the pull-ring 108. Similarly, users with arthritis or other disabilities (e.g., missing digits) may have great difficulty interfacing with the tab 106-2 and/or pull-ring 108 recessed within the spout or may have difficulty exerting enough pull-force on the seal 106 to properly separate the seal 106 from the spout 104. In some cases, the force and/or angle of force applied to the pull-ring 108 and/or tab 106-2 may cause one or more of the pull-ring 108 and the tab 106-2 to fail (e.g., tear, rip, or break), requiring the user to employ a fork, knife, or other tool in an attempt to sever the seal 106 from the spout 104. Such failure recovery actions may result in portions of the seal 106 (or the entire seal 106) falling into the container 102 and contaminating the typically consumable liquid within. Also, as the rotational orientation of the spout 104 to the container 102 is not standardized (e.g., random), the orientation of the container that is necessary for a user to engage with the pull-ring 108 varies and accordingly requires visual inspection upon removal of the cap 110 for each new container 102 to be opened (e.g., to identify where along the perimeter of the seal 106 the tab 106-2 is located). For users with poor eyesight, achieving the proper orientation may be time-consuming and/or frustrating.

III. Pull-Tab Seal Extraction Tool Systems and Methods

Figure 2:
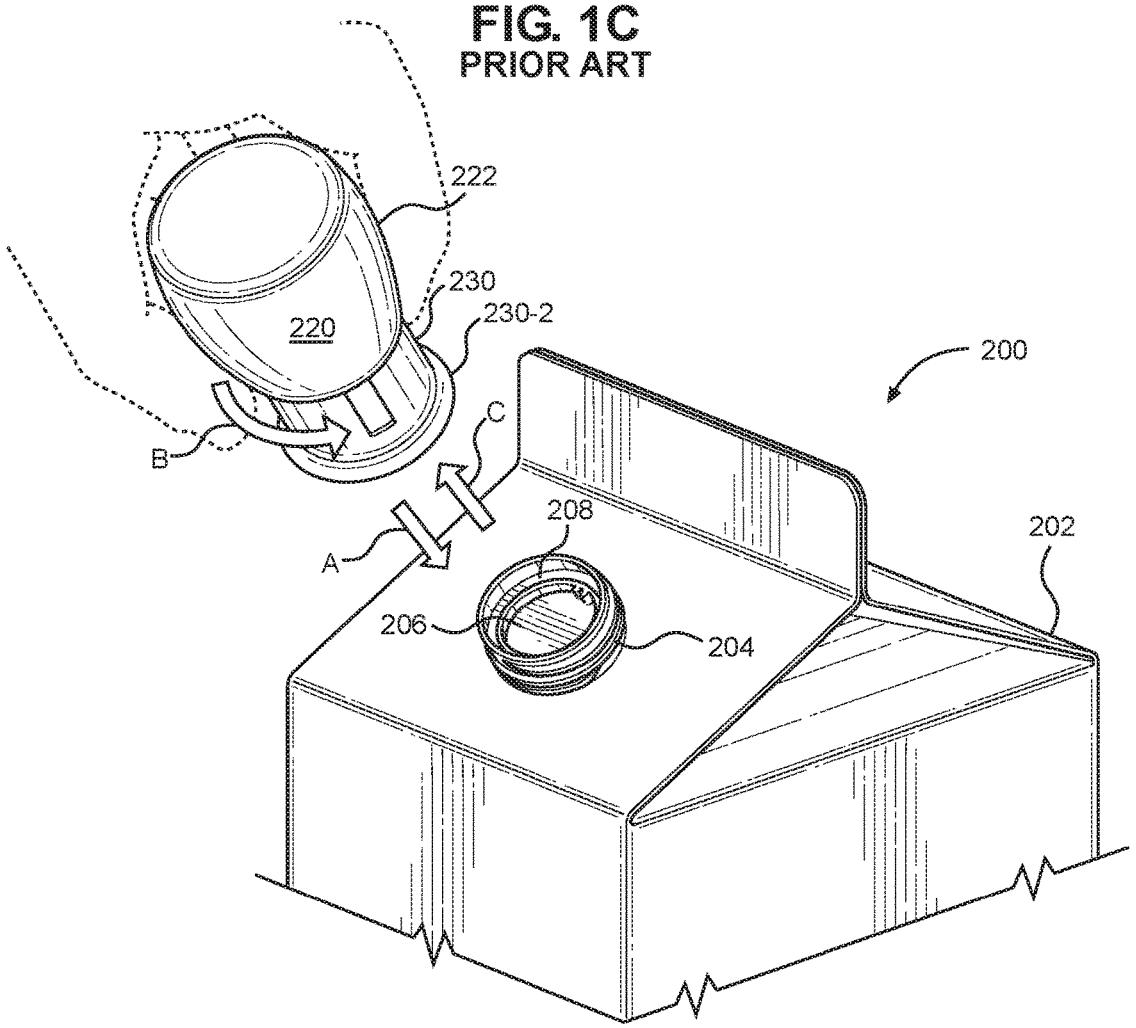
FIG. 2 is a perspective diagram of a system according to some embodiments.

Turning to FIG. 2, a perspective diagram of a system 200 according to some embodiments is shown. The system 200 may comprise, for example, a container 202 having a spout 204 with an integral seal 206 and pull-ring 208. According to some embodiments, an extraction tool 220 may be utilized to permit a user to easily extract the seal 206 from the spout 204 with application of a lower level of dexterity and/or force than is necessitated by manual extraction. The extraction tool 220 may, in some embodiments, comprise a cover 222 that is grasped by the user (represented by phantom lines in FIG. 2) and a body portion 230 comprising a foot 230-2.

According to some embodiments, the extraction tool 220 may be engaged with the container 202 by aligning the body portion 230 with the spout 204 and advancing the foot 230-2 toward the spout 206, as depicted by the arrow labeled "A" in FIG. 2. In some embodiments, once the foot 230-2 is engaged with the container 202 (such engagement not shown in FIG. 2) and/or the extraction tool 220 is compressed as described in more detail herein, the extraction tool 220 may be rotated/twisted as depicted by the arrow labeled "B" in FIG. 2. The body portion 230 may be engaged or positioned to enshroud the spout 204, for example, and internal components (not shown in FIG. 2) of the extraction tool 220 may be reactive to the compression and/or twisting/rotational action to engage with, puncture, separate, extract, and/or remove the seal 206 from the spout 204. According to some embodiments, after the seal 206 has been separated by the extraction tool 220, the user may disengage the extraction tool 220 from the container 202 (e.g., thereby extracting the seal 206 therefrom), as depicted by the arrow labeled "C" in FIG. 2.

According to some embodiments, any or all of the components 202, 204, 206, 208, 220, 222, 230, 230-2 of the system 200 may be similar in configuration and/or functionality to any similarly named and/or numbered components described herein. Fewer or more components 202, 204, 206, 208, 220, 222, 230, 230-2 (and/or portions thereof) and/or various configurations of the components 202, 204, 206, 208, 220, 222, 230, 230-2 may be included in the system 200 without deviating from the scope of embodiments described herein. In some embodiments, one or more of the various components 202, 204, 206, 208, 220, 222, 230, 230-2 may not be needed and/or desired in the system 200.

Figure 3A:
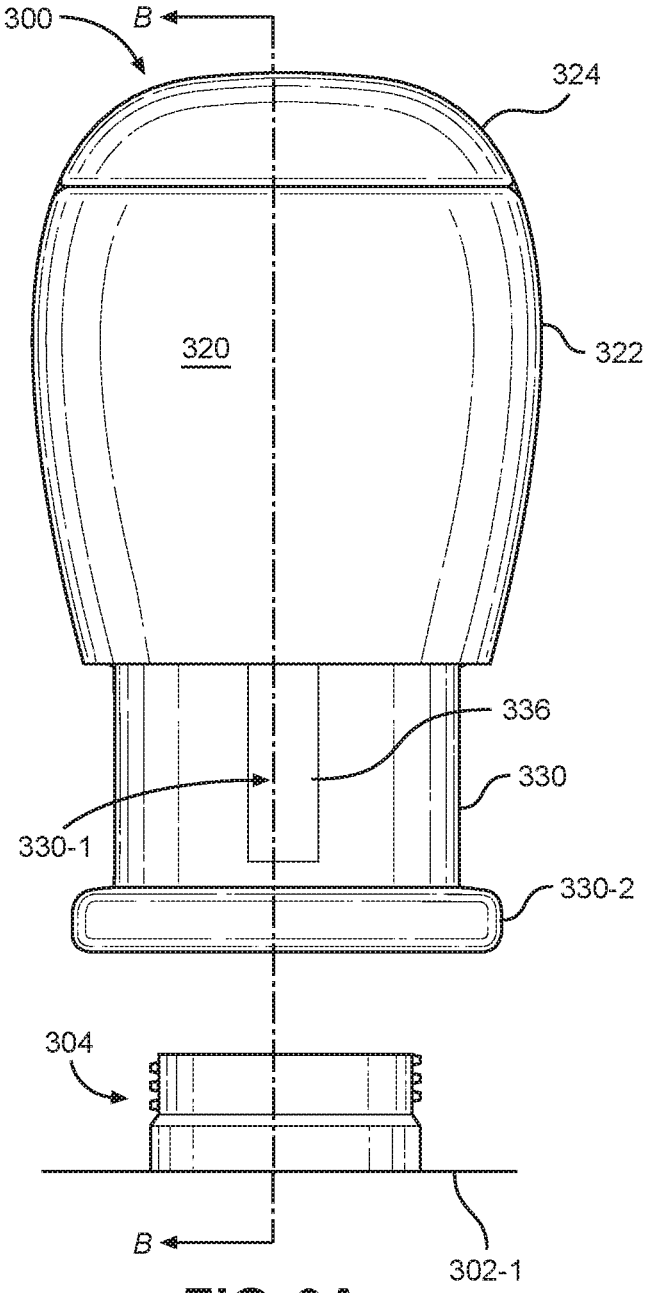
FIG. 3A, FIG. 3B, FIG. 3C, FIG. 3D, FIG. 3E, FIG. 3F, FIG. 3G, and FIG. 3H, are side and cross-sectional views of a system according to some embodiments.

Referring now to FIG. 3A, FIG. 3B, FIG. 3C, FIG. 3D, FIG. 3E, FIG. 3F, FIG. 3G, and FIG. 3H, side and cross-sectional views of a system 300 according to some embodiments are shown. In some embodiments, the system 300 as depicted in FIG. 3A may comprise or be similar to a side view of the system 200 of FIG. 2 herein and/or the cross-sectional views of FIG. 3B, FIG. 3C, FIG. 3D, FIG. 3E, FIG. 3F, FIG. 3G, and FIG. 3H may comprise or be similar to cross-sectional views of the system 200 of FIG. 2 herein.

The system 300 may comprise, for example, a dispensing surface 302-1 defining a dispensing hole 302-2 through which a spout 304 is disposed (and/or to which the spout 304 is coupled). The spout 304 may house and/or be plugged by an integral seal 306. In some embodiments, the seal 306 may comprise a seal groove 306-1 defined at or proximate to a coupling location between the seal 306 and the interior of the spout 304. According to some embodiments, the spout 304 may be designed to facilitate separation and/or extraction of the seal 306 by incorporating one or more of a tab 306-2 and a pull-ring 308. To solve various deficiencies such as those described herein, the system 300 may comprise an extraction tool 320 that is utilized to sever, separate, remove, and/or extract the seal 306 in place of the typical process that requires a user to engage their fingers with the tab 306-2 and/or the pull-ring 308.

In some embodiments, the extraction tool 320 may comprise a cover 322 that is hollow and/or otherwise defines an interior volume 322-1. According to some embodiments, the cover 322 may be shaped to facilitate gripping by a user (not shown) with disabilities. The cover 322 may, for example, comprise a rounded conical, hood, bullet, and/or mushroom shape with a diameter of between two inches (2-in; 5.08-cm) and four inches (4-in; 10.16-cm). In some embodiments, the cover 322 may be constructed of wood, plastic, metal, and/or composite materials and/or may comprise one or more grip enhancements (not shown) such as etching, grooves, non-slip coating, knurling, rubber, and/or foam. According to some embodiments, the cover 322 may be ergonomically shaped to fit comfortably within a palm of the user's hand, providing a less painful gripping scenario for some users as compared to requiring a finger to be inserted into the spout 304 to retrieve and/or engage with the pull-ring 308. According to some embodiments, the cover 322 may comprise and/or be coupled to a cap 324. In some embodiments, the cap 324 may be integrated with and/or shaped to cooperate with the ergonomic shaping of the cover 322.

Figure 3B:
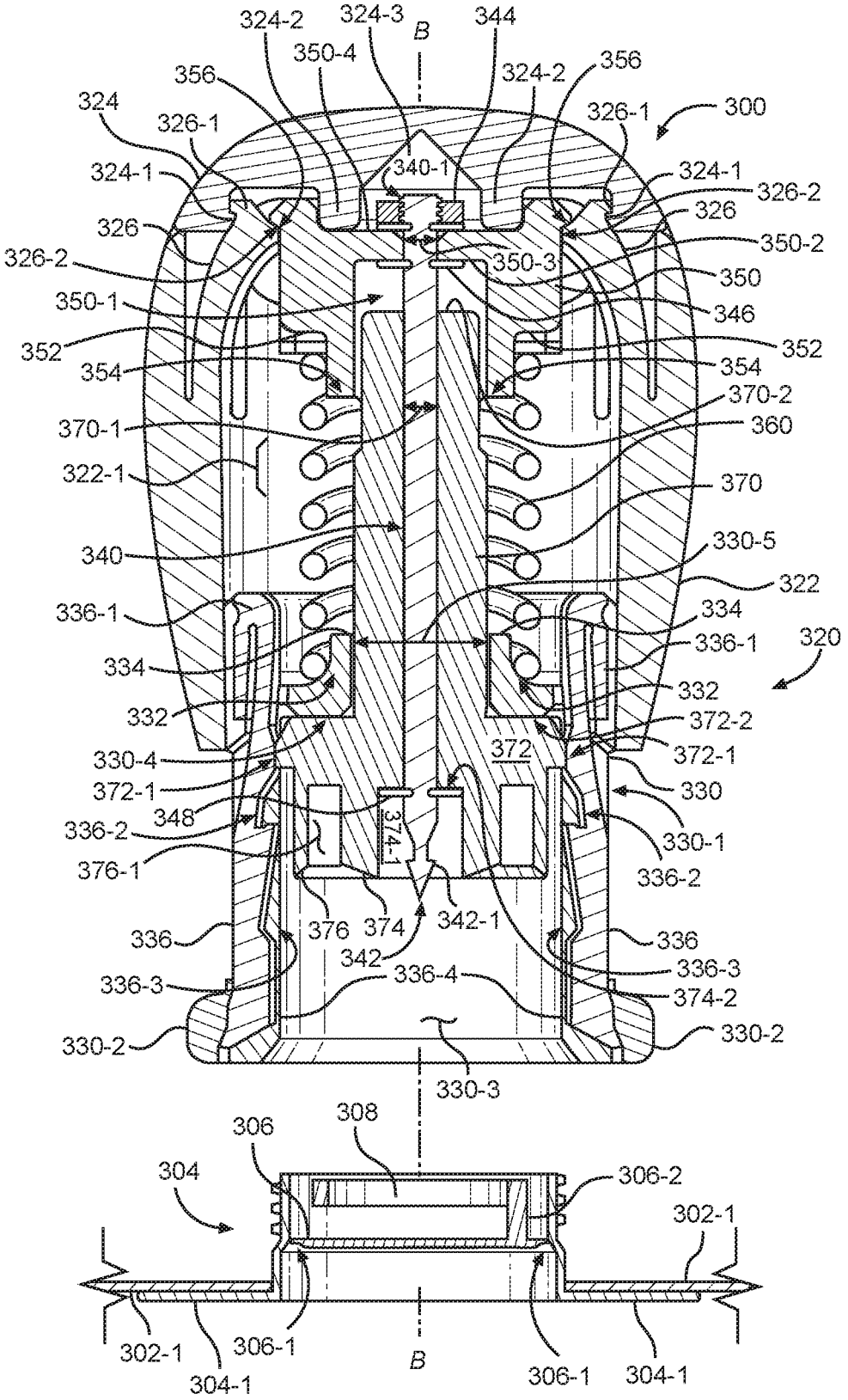

According to some embodiments, the cap 324 may be selectively removable from the cover 322. The cap 324 may comprise, for example, one or more cover catches 324-1 such as may be embodied by an interior flange. In some embodiments, the cap 324 may comprise one or more crown standoffs 324-2 such as may be defined by an interior collar that defines a head space 324-3. In some embodiments, the cover 322 may comprise and/or be coupled to one or more retaining arms 326 such as the integral retaining arms 326 depicted. According to some embodiments, the retaining arms 326 may be pliable and/or biased in a radially outward direction. The retaining arms 326 may be selectively flexed and/or repositioned radially inwardly (with respect to a biased resting position that is more radially outward), for example, to permit the cap 324 to be snapped in place and/or retained, as depicted in FIG. 3B. In some embodiments, in the case that the cap 324 is engaged with or snapped in place and coupled to the cover 322, each cover catch 324-1 may engage with and hold a cap retaining lobe 326-1 of each respective retaining arm 326. Each cap retaining lobe 326-1 may exert radially outward force on each respective cover catch 324-1, for example, thereby retaining the cap 324 on the cover 322. According to some embodiments, the cap 324 may be selectively removed from the cover 322 by application of radially inward pressure on one or more of the retaining arms 326. In some embodiments, two (2) retaining arms 326 disposed radially opposite from each other may be included in the extraction tool 320. According to some embodiments, the retaining arms 326 may comprise crown catches 326-2, e.g., disposed on opposite sides of engaging ends of the retaining arms 326 with respect to the cap retaining lobes 326-1.

In some embodiments, the extraction tool 320 may comprise a body portion 330 that is slidably coupled to the cover 322. The body portion 330 may nest within the interior volume 322-1 and/or may be slidably coupled to permit axial travel of the body portion 330 within the interior volume 322-1. According to some embodiments, the body portion 330 may by cylindrically-shaped and may comprise a first end disposed within the interior volume 322-1, one or more pawl slots 330-1 (or cutouts) disposed in a cylindrical side-wall thereof, and/or may comprise a foot 330-2 at a second end (e.g., distal from the cover 322). In some embodiments, the body portion 330 may define an extraction socket 330-3 comprising an internal extraction socket ceiling 330-4. In some embodiments, the body portion 330 may comprise a piston bore 330-5 coaxially aligned with the extraction socket 330-3 and extending through the first end of the body portion 330 and to (e.g., through) the extraction socket ceiling 330-4. According to some embodiments, the extraction socket 330-3 may be sized to accommodate the spout 304. In some embodiments, such as in the case that the spout 304 comprises an outside diameter of one and ninety-five thousands of an inch (1.095-in; 2.781-cm) for example, the extraction socket 330-3 may comprise an inside diameter of between one and one tenth of an inch (1.1-in; 2.565-cm) and one and twenty-five hundredths of an inch (1.25-in; 3.175-cm).

According to some embodiments, the first end of the body portion 330 may comprise a lower spring seat 332 and/or an upper extent (e.g., a collar) defining a crown stop surface 334. In some embodiments, the body portion 330 may comprise and/or be coupled to one or more safety pawls 336, e.g., disposed in, mounted through, and/or coupled to one or more of the pawl slots 330-1. According to some embodiments, each safety pawl 336 may comprise a pawl coupling 336-1 via which the safety pawl 336 is coupled to the body portion 330. As depicted in FIG. 3B, the pawl coupling 336-1 may comprise a hook feature that snaps onto the body portion 330 such that the safety pawl 336 is positioned within the pawl slot 330-1. In some embodiments, the pawl coupling 336-1 may comprise a biasing feature, such as the depicted hook feature, that permits the safety pawl 336 to be urged radially outward from a resting position within the extraction socket 330-3. According to some embodiments, the safety pawl 336 may comprise one or more features disposed and/or formed on an inner surface within the extraction socket 330-3. The safety pawl 336 may comprise, for example, a safety catch 336-2, a seat 336-3, and/or a spout engaging surface 336-4.

In some embodiments, an extraction shaft 340 may be disposed within the interior volume 322-1 and/or within the extraction socket 330-3. The extraction shaft 340 may, according to some embodiments, comprise shaft threads 340-1 disposed on a first or upper end thereof and a piercing element 342 (e.g., a penetration tip or element) disposed and/or formed on a second or lower end thereof. The extraction shaft 340 may, for example, be coupled within the interior volume 322-1 such that the piercing element 342 extends into the extraction socket to engage with the seal 306 in the case that the spout 304 is engaged by the extraction tool 320. According to some embodiments, the extraction shaft 340 (and/or the piercing element 342) may comprise a barb 342-1 and/or other retention feature that discourages or impedes removal of the piercing element 342 from the seal 306 (e.g., once engaged/pierced). In some embodiments, the extraction shaft 340 may be coupled, retained, and/or restrained by various mounting and/or coupling features such as a shaft nut 344 engaged with the shaft threads 340-1 at the first end, an upper shaft clip 346 disposed proximate to the first end, and a lower shaft clip 348 disposed proximate to the second end and/or the barb 342-1. The upper shaft clip 346 and the lower shaft clip 348 may, in some embodiments, comprise any type or configuration of clips, retainers, nuts, flanges, and/or other features either integral or coupled, that extend radially outward beyond a diameter of the extraction shaft 340. The upper shaft clip 346 and/or the lower shaft clip 348 may, for example, comprise "C" or "E"-clips snapped onto and/or removable coupled to retaining grooves or features (not shown) of the extraction shaft 340. In some embodiments, at least one of the shaft nut 344, the upper shaft clip 346, and the lower shaft clip 348 may comprise or be replaced with an integral flange of the extraction shaft 340.

According to some embodiments, the extraction shaft 340 may be coupled to the cover 322 such that a downward axial movement of the cover 322 with respect to the body portion 330 (e.g., a downward sliding movement and/or compression) engages the extraction shaft 340 and/or the piercing element 342 thereof with the seal 306 (e.g., in the case that the spout 304 is situated within the extraction socket 330-3). In some embodiments the extraction shaft 340 may be coupled to the cover 322 by a crown 350. The crown 350 may, for example, comprise a cylindrically-shaped element comprising and/or defining a piston socket 350-1 (or first bore) comprising a piston socket ceiling 350-2. In some embodiments, the crown 350 may comprise and/or define a shaft bore 350-3 (or second bore) extending from an upper crown surface 350-4 and to (e.g., through) the piston socket ceiling 350-2. According to some embodiments, the extraction shaft 340 may be disposed through the shaft bore 350-3 and into or through the piston socket 350-1. The shaft nut 344 may be disposed above and/or on the upper crown surface 350-4 and may comprise a diameter greater than the shaft bore 350-3, for example, thereby preventing the extraction shaft 340 from passing downward and/or axially through the shaft bore 350-3 and/or otherwise restraining downward axial movement of the extraction shaft 340 with respect to the shaft bore 350-3 and/or the crown 350. In some embodiments, the shaft nut 344 may also or alternatively comprise a clip, pin, flange, and/or other restraining feature. According to some embodiments, the upper shaft clip 346 may be coupled to the extraction shaft 340 within the piston socket 350-1 and/or adjacent to the piston socket ceiling 350-2, thereby restraining the extraction shaft 340 from upward axial movement with respect to the shaft bore 350-3 and/or the crown 350.

In some embodiments, the crown 350 may comprise and/or define an upper spring seat 352 and/or a lower extent (e.g., a collar) and/or stop surface 354. According to some embodiments, the crown 350 may comprise and/or define a retention flange 356. The retention flange 356 may, for example, comprise a catch that is defined by a portion of the crown 350 that increases the diameter of the crown 350 proximate to the upper crown surface 350-4. As depicted in FIG. 3B, for example, the retention flange 356 may engage with the crown catches 326-2 of the retaining arms 326 of the cover 322. The engagement of the retention flange 356 with the crown catches 326-2 may, in some embodiments, prevent downward axial movement or displacement of the crown 350 with respect to the retaining arms 326 and/or the cover 322. In some embodiments, the crown standoffs 324-2 may engage with the upper crown surface 350-5, thereby preventing upward axial movement or displacement of the crown 350 with respect to the retaining arms 326, the cap 324, and/or the cover 322.

According to some embodiments, a spring 360 may be disposed within the interior volume 322-1 to provide an axially resistive and/or biasing force between the cover 322 and the body portion 330. The spring 360 may, for example, be disposed in and/or engaged with or between each of the upper spring seat 352 of the crown 350 and the lower spring seat 332 of the body portion 330. In such a manner, for example, downward force on and/or movement of the cover 322 (and/or crown 350 and/or extraction shaft 340) may apply a compressive force to the spring 360 as the cover 322 slidably moves axially downward with respect to the body portion 330. Removal of the downward force may accordingly allow the spring 360 to decompress, thereby urging or forcing the cover 322 (and/or crown 350 and/or extraction shaft 340) axially upward to be repositioned at or near the original axial position of the cover 322 with respect to the body portion 330.

In some embodiments, the extraction tool 320 may comprise a piston 370. The piston 370 may, for example, comprise a shaft bore 370-1 extending from and through an upper piston surface 370-2 at a first end of the piston 370, to (e.g., through) a second end of the piston 370. In some embodiments, the piston 370 may comprise an extraction head 372 disposed and/or formed at the second end. According to some embodiments, the extraction head 372 may comprise a separate component from the piston 370. In some embodiments (e.g., as depicted in FIG. 3B), the extraction head 372 may be integral to the piston 370. The extraction head 372 may, in some embodiments, comprise a diameter (e.g., a second diameter) that is larger than a primary diameter of the piston 370. According to some embodiments, the extraction head 372 may comprise one or stop lobes 372-1 (e.g., a stop flange) formed at the extents of the diameter of the extraction head 372 and/or proximate to an upper extraction head surface 372-2 at a first or upper end of the extraction head 372. In some embodiments, the extraction head 372 may comprise a seal stop 374 disposed, coupled to, and/or formed at a second or lower end of the extraction head 372 (and/or the second end of the piston 370). The seal stop 374 may comprise a collar and/or cylindrical protrusion from the second end of the extraction head 372 (and/or second end of the piston 370), for example, that defines a cavity, socket, or seal release chamber 374-1 defining a seal release chamber ceiling 374-2 through which the shaft bore 370-1 extends. As depicted in FIG. 3B, a portion of the extraction shaft 340 (e.g., the piercing element 342 and/or the barb 342-1) may be disposed within the seal release chamber 374-1. In some embodiments, the lower shaft clip 348 may be coupled to the extraction shaft 340 within the seal release chamber 374-1 and/or adjacent to the seal release chamber ceiling 374-2. The lower shaft clip 348 may comprise a diameter larger than the shaft bore 370-1, for example, thereby preventing the extraction shaft 340 from passing upward and/or axially through the shaft bore 370-1 and/or otherwise restraining upward axial movement of the extraction shaft 340 with respect to the shaft bore 370-1 and/or the piston 370 (and/or the extraction head 372).

According to some embodiments, the extraction head 372 and/or the piston 370 may comprise a seal gap separator 376. The seal gap separator 376 may comprise, for example, a collar, ring, cutter, and/or one or more protrusions from the extraction head 372. In some embodiments, a pull-ring socket 376-1 (or slot) may be formed between the seal gap separator 376 and the seal stop 374. In the case that the spout 304 is disposed within the extraction socket 330-3, for example, the pull-ring 308 and/or the tab 306-2 may be disposed within the pull-ring socket 376-1 (e.g., so that the extraction shaft 340 and/or the seal gap separator 376 may operate on the seal 306 through and around the pull-ring 308 and the tab 306-2—e.g., without interference therefrom).

Various operational stages, states, and/or moments in time of the various components 322, 322-1, 324, 324-1, 324-2, 324-3, 326, 326-1, 326-2, 330, 330-1, 330-2, 330-3, 330-4, 330-5, 332, 334, 336, 336-1, 336-2, 336-3, 336-4, 340, 340-1, 342, 342-1, 344, 346, 348, 350, 350-1, 350-2, 350-3, 350-4, 352, 354, 356, 360, 370, 370-1, 370-2, 372, 372-1, 372-2, 374, 374-1, 374-2, 376, 376-1 of the extraction tool 320 as utilized to safely, painlessly, reliably, easily, and/or quickly remove the seal 306 from the spout 304 are depicted in FIG. 3B, FIG. 3C, FIG. 3D, FIG. 3E, FIG. 3F, FIG. 3G, and FIG. 3H. The system 300 depicted in FIG. 3B may comprise, for example, a first state and/or time such as a state of rest or pre-engagement. While all components 322, 322-1, 324, 324-1, 324-2, 324-3, 326, 326-1, 326-2, 330, 330-1, 330-2, 330-3, 330-4, 330-5, 332, 334, 336, 336-1, 336-2, 336-3, 336-4, 340, 340-1, 342, 342-1, 344, 346, 348, 350, 350-1, 350-2, 350-3, 350-4, 352, 354, 356, 360, 370, 370-1, 370-2, 372, 372-1, 372-2, 374, 374-1, 374-2, 376, 376-1 of the system 300 are depicted and labeled in FIG. 3B, various components that appear in one or more of the other views in FIG. 3C, FIG. 3D, FIG. 3E, FIG. 3F, FIG. 3G, and FIG. 3H may be similar or identical to those labeled in FIG. 3B, but may not be labeled for ease of reference or illustration. As depicted in FIG. 3B, e.g., at the first time and/or state, the cover 322 may be disposed at a first axial position with respect to the body portion 330, the spring 360 may be uncompressed or compressed by a first amount, the piston socket 350-1 may comprise a first height between the piston socket ceiling 350-2 and the upper piston surface 370-2, the upper extraction head surface 372-2 may be in contact with the extraction socket ceiling 330-4, and/or the lower shaft clip 348 may be in contact with the seal release chamber ceiling 374-2.

Figure 3C:
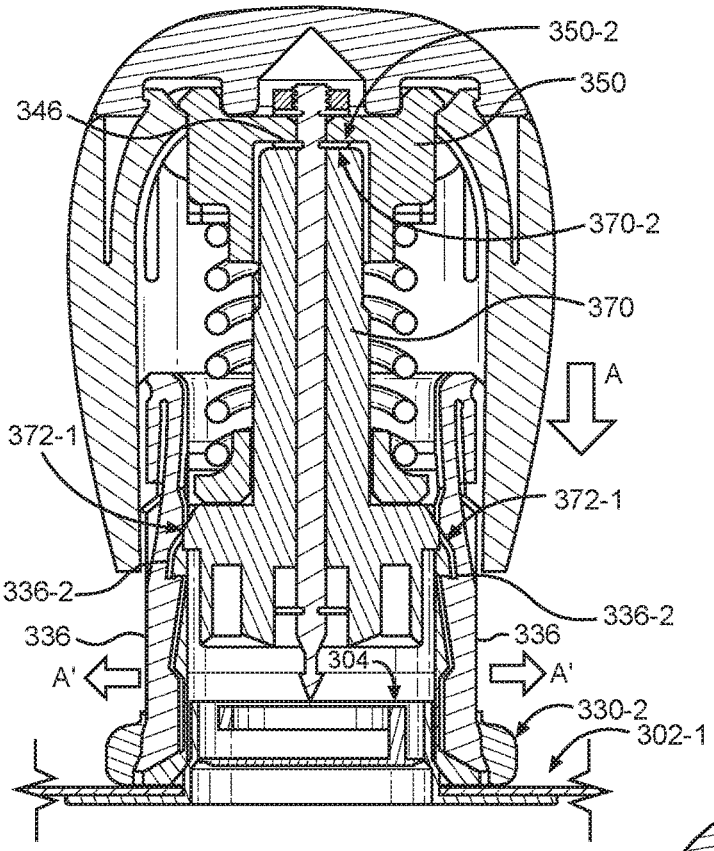

According to some embodiments, the extraction tool 320 (and/or the system 300) may be transitioned to a second time and/or state by application of a downward axial force on the cover 322 (and/or the cap 324), e.g., as depicted by the downward arrow labeled A in FIG. 3C. As depicted in FIG.

3C, e.g., at the second time and/or state (e.g., a first stage of engagement), the cover 322 may be disposed at a second axial position with respect to the body portion 330, the spring 360 may be compressed by a second amount (e.g., greater than the first amount), the piston socket 350-1 may comprise a second height between the piston socket ceiling 350-2 and the upper piston surface 370-2 (e.g., less than the first height and/or equal to zero (0); in other words, the piston socket ceiling 350-2 (and/or the upper shaft clip 346) may be engaged with and/or apply downward force onto the upper piston surface 370-2), the upper extraction head surface 372-2 may still be in contact with the extraction socket ceiling 330-4, and/or the lower shaft clip 348 may have moved axially downward and/or away from the seal release chamber ceiling 374-2. According to some embodiments, movement and/or compression in accordance with the arrow labeled A in FIG. 3C and/or engagement of the foot 330-2 with the dispensing surface 302-1, may cause the safety pawls 336 to be urged radially outward, e.g., in accordance with the arrows labeled A' in FIG. 3C.

In some embodiments, for example, the spout engaging surfaces 336-4 of the safety pawls 336 may be positioned within the extraction socket 330-3 such that engagement of the extraction tool 320 with the spout 304 causes the spout engaging surfaces 336-4 to contact the spout 304. In the case that the extraction tool 320 is placed onto (e.g., enshrouds) the spout 304 (e.g., as shown in FIG. 3C) and in the case that the extraction tool 320 comprises two (2) radially opposed safety pawls 336 (as depicted), for example, the resting radial positions of the safety pawls 336 may define a clearance diameter within the extraction socket 330-3 that is smaller than a diameter of the extraction socket 330-3 and/or smaller than an outside diameter of the spout 304. In such a manner, for example, placement of the extraction tool 320 onto the spout 304 may cause the spout 304 to engage with the spout engaging surfaces 336-4 of the safety pawls 336 and urge the safety pawls 336 radially outward (at least at ends thereof distal from the pawl couplings 336-1; e.g. in accordance with the arrows labeled A'). In such a manner, for example, the safety catches 336-2 may be positioned radially outward to permit axial passage of the stop lobes 372-1.

Figure 3D:
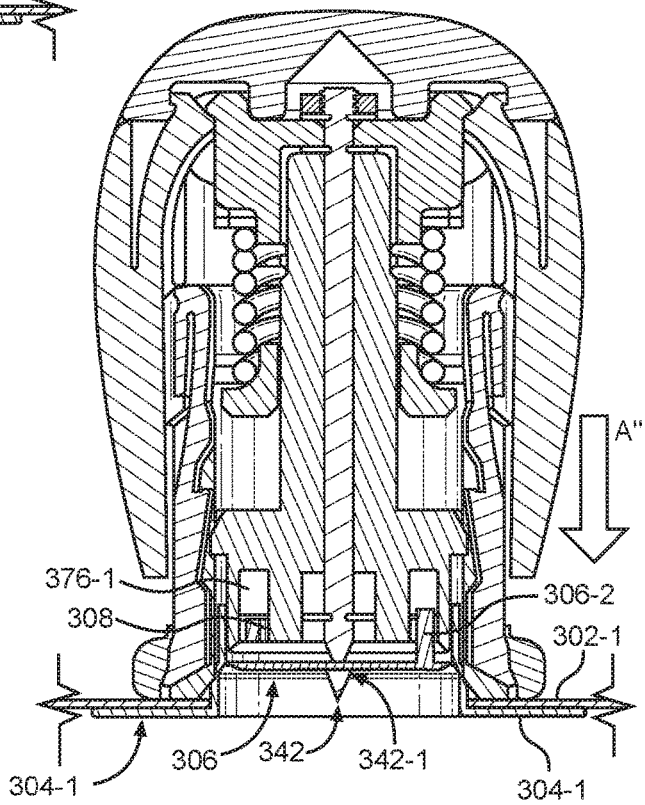

According to some embodiments, the extraction tool 320 (and/or the system 300) may be transitioned to a third time and/or state by continued (or renewed) application of a downward axial force on the cover 322 (and/or the cap 324), e.g., as depicted by the downward arrow labeled A" in FIG. 3D. As depicted in FIG. 3D, e.g., at the third time and/or state (e.g., a second stage of engagement), the cover 322 may be disposed at a third axial position with respect to the body portion 330, the spring 360 may be compressed by a third amount (e.g., greater than the second amount), the piston socket ceiling 350-2 (and/or the upper shaft clip 346) may continue to be engaged with and/or apply downward force onto the upper piston surface 370-2, the upper extraction head surface 372-2 may have moved axially downward and/or away from the extraction socket ceiling 330-4, and/or the piercing element 342 (and/or the barb 342-2) may have penetrated and/or otherwise engaged with the seal 306. According to some embodiments, the tab 306-2 and/or the pull-ring 308 may be disposed within the pull-ring socket 376-1.

Figure 3E:
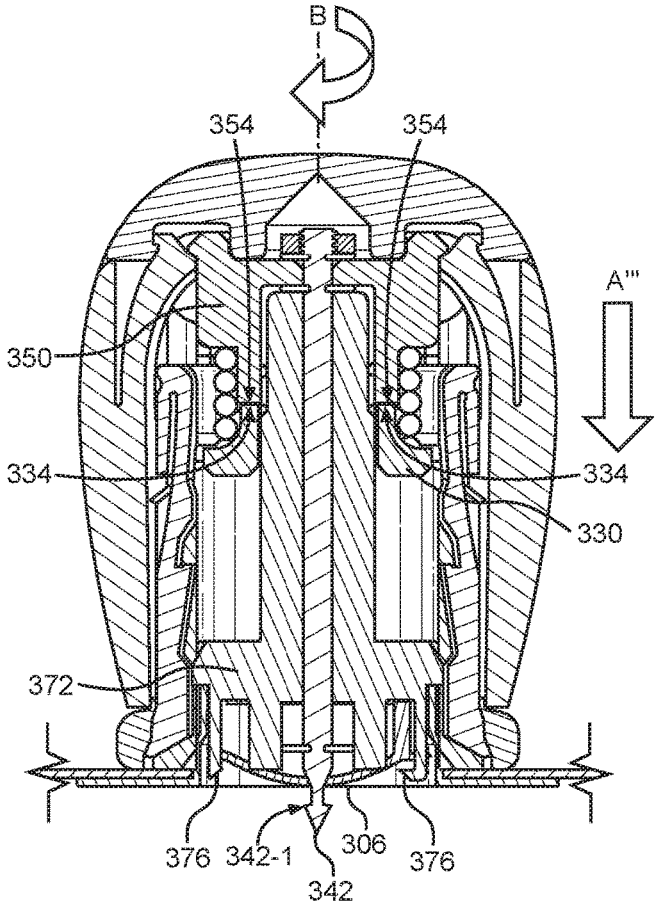

In some embodiments, the extraction tool 320 (and/or the system 300) may be transitioned to a fourth time and/or state by continued (or renewed) application of a downward axial force on the cover 322 (and/or the cap 324), e.g., as depicted by the downward arrow labeled A'" in FIG. 3E, and/or by application of a rotational force or action, e.g., as depicted by the axial rotation arrow labeled B in FIG. 3E. As depicted in FIG. 3E, e.g., at the fourth time and/or state (e.g., a third stage of engagement), the cover 322 may be disposed at a fourth axial position (e.g., a final or lowest axial position) with respect to the body portion 330, the spring 360 may be compressed by a fourth amount (e.g., greater than the third amount and/or a final or greatest amount), the piston socket ceiling 350-2 (and/or the upper shaft clip 346) may continue to be engaged with and/or apply downward force onto the upper piston surface 370-2, the upper extraction head surface 372-2 may have moved further axially downward and/or away from the extraction socket ceiling 330-4 and/or into the spout 304, and/or the seal gap separator 376 may have penetrated, broken, and/or otherwise engaged with the seal groove 306-1. According to some embodiments, at the fourth time and/or state, the seal 306 may be completely separated from the spout 304 and may be retained by the barb 342-1. In some embodiments, further downward axial movement of the cover 322 may be prevented by engagement of the stop surface 354 of the crown 350 with the crown stop surface 334 of the body portion 330. According to some embodiments, such as in the case that the seal gap separator 376 comprises one or more protrusions from the extraction head 372, downward force or movement depicted by the downward arrow labeled A'" in FIG. 3D may cause the seal gap separator 376 to penetrate the seal 306 at least at one location along a circumference of the seal groove 306-1. In some embodiments, rotational movement in accordance with the axial rotation arrow labeled B in FIG. 3E may further cause the seal gap separator 376 to travel along the circumference of the seal groove 306-1, extending the length of the puncture and/or separation. According to some embodiments, the amount of rotation B may be dependent upon an amount and/or circumferential length of the seal gap separator 376. In the case that a single seal gap separator 376 protrudes at a single point along the circumference, for example, in the case that rotational force B is desired, it may comprise a full rotation to allow the seal gap separator 376 to travel along the entire circumferential course of the seal groove 306-1. More seal gap separators 376 and/or circumferentially wider seal gap separators 376 may reduce the amount of rotation B that would be necessary to allow the seal gap separators 376 to travel along a desired amount of the circumferential length of the seal groove 306-1. In some embodiments, the entire circumferential length of the seal groove 306-1 need not be traversed by the seal gap separator(s) 376. Only a portion of the seal groove 306-1 may need to be separated, for example, to permit removal of the seal 306 utilizing the extraction shaft 340.

Figure 3F:
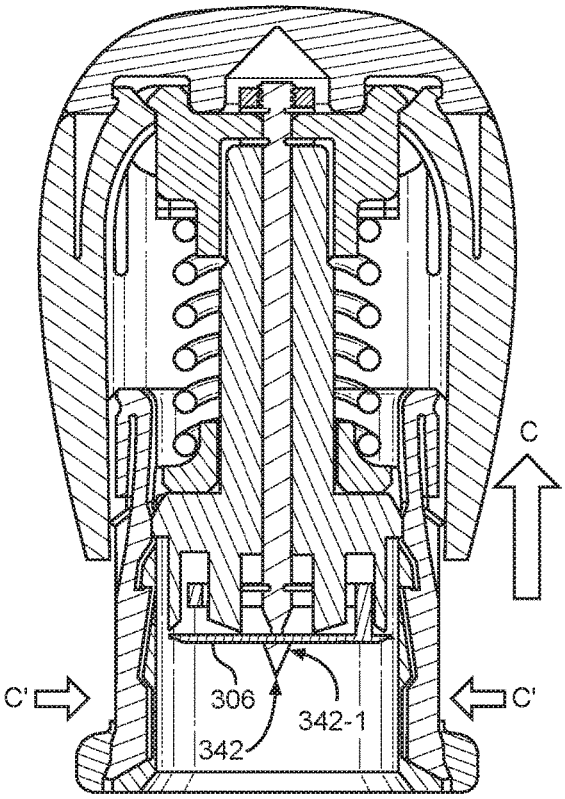

According to some embodiments, the extraction tool 320 (and/or the system 300) may be transitioned to a fifth time and/or state by application of an upward axial force (or a release or cessation of a downward force) on the cover 322 (and/or the cap 324), e.g., as depicted by the upward arrow labeled C in FIG. 3F. As depicted in FIG. 3F, e.g., at the fifth time and/or state (e.g., a fourth stage of engagement), the cover 322 may be disposed at a fifth axial position (e.g., similar to the second axial position) with respect to the body portion 330, the spring 360 may be compressed by a fifth amount (e.g., less than the fourth amount), the upper extraction head surface 372-2 may have moved axially upward to engage with the extraction socket ceiling 330-4, the piercing element 342 (and/or the barb 342-2) may continue to retain the seal 306 and may be disposed outside of the seal release chamber 374-1, and/or the lower shaft clip 348 may be disposed within the seal release chamber 374-1 but may not yet be engaged (or re-engaged) with the seal release chamber ceiling 374-2. In some embodiments, the upward movement of the cover 322 depicted by the upward arrow labeled C in FIG. 3F (and caused by user engagement or user disengagement that permits the spring 360 to release energy to decompress to the fifth amount of compression) may permit the safety pawls 336 to return to their axially inward resting positions (e.g., by moving the stop lobes 372-1 of the extraction head 372 axially upwards to disengage with the safety pawls 336—and/or to maintain engagement but be guided along a cammed interior surface of the safety pawls 336 that permits radially inward movement of the safety pawls 336), e.g., as depicted by the radially inward arrows labeled C' in FIG. 3F.

Figure 3G:
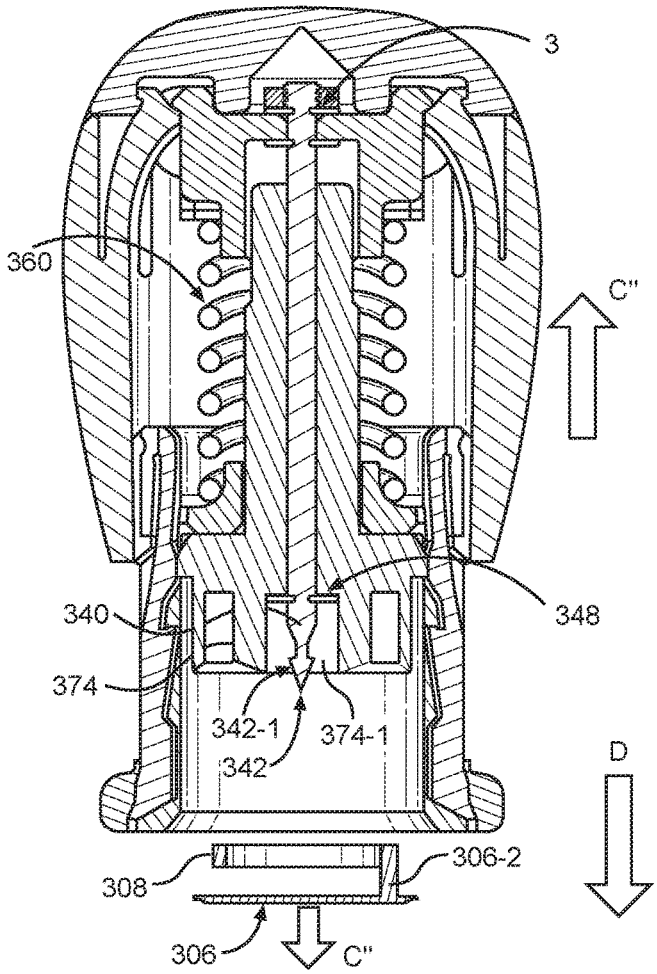

In some embodiments, the extraction tool 320 (and/or the system 300) may be transitioned to a sixth time and/or state by continued (or renewed) application of upward axial force on the cover 322 (and/or the cap 324), e.g., as depicted by the upward arrow labeled C" in FIG. 3G. As depicted in FIG. 3G, e.g., at the sixth time and/or state (e.g., a fifth stage of engagement, or a state of disengagement), the cover 322 may be disposed at a sixth axial position (e.g., a highest or original axial position such as the first axial position) with respect to the body portion 330, the spring 360 may be compressed by a sixth amount (e.g., less than the fifth amount and/or an original or least amount such as the first amount), the piston socket ceiling 350-2 (and/or the upper shaft clip 346) may be disengaged from the upper piston surface 370-2 and/or the piston socket 350-1 may comprise the first height between the piston socket ceiling 350-2 and the upper piston surface 370-2, the upper extraction head surface 372-2 may be engaged with the extraction socket ceiling 330-4, the lower shaft clip 348 may be engaged with the seal release chamber ceiling 374-2, and/or the penetration tip 342 and/or the barb 342-1 may be disposed within the seal release chamber 374-1. The upward axial force at C' may, for example, pull the penetration tip 342 and/or the barb 342-1 upward axially into the seal release chamber 374-1, thereby causing the seal 306 to engage with the seal stop 374. According to some embodiments, engagement of the seal 306 with the seal stop 374 may permit the penetration tip 342 and/or the barb 342-1 to be extracted from the seal 306, which may accordingly allow the seal 306 (and/or the tab 306-2 and the pull-ring 308) to fall from the extraction socket 330-3, e.g., in accordance with the downward arrow labeled C'" in FIG. 3G.

Figure 3H:
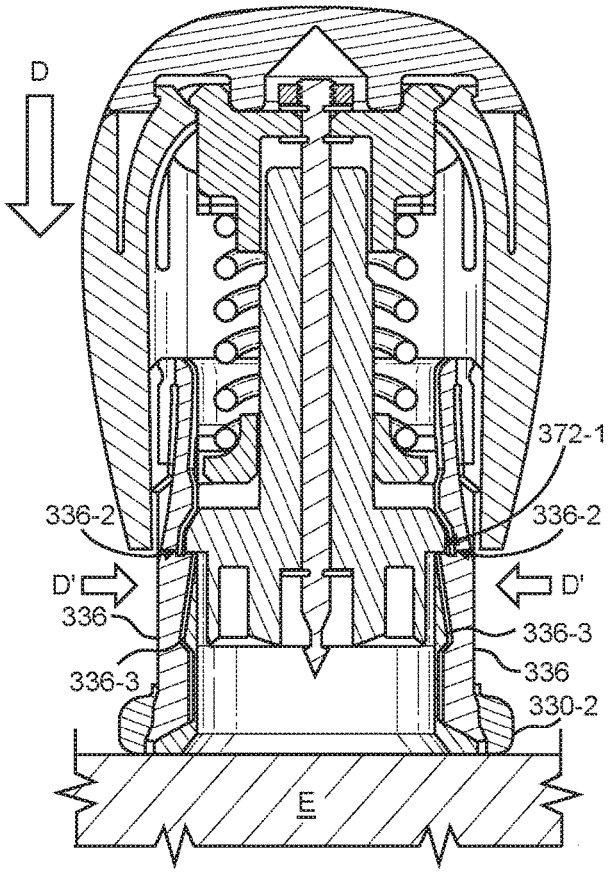

According to some embodiments, the extraction tool 320 (and/or the system 300) may be transitioned to a seventh time and/or state by application of a downward axial force on the cover 322 (and/or the cap 324), e.g., as depicted by the downward arrow labeled D in FIG. 3H. As depicted in FIG. 3H, e.g., at the seventh time and/or state, the cover 322 may be disposed at a seventh axial position with respect to the body portion 330, the safety catches 336 may be biased radially inward (e.g., in accordance with the radially inward arrows labeled D' in FIG. 3H), the stop lobes 374-1 of the extraction head 374 may be seated in (or retained or stopped by) the safety catches 336-2 of the safety pawls 336, and/or the seal gap separator 376 may be disposed in the seats 336-3. The seventh time and/or state may represent, for example, a case where downward force D is applied to the extraction tool 320 while the extraction tool 320 (and/or the foot 330-2 thereof) rests or otherwise is disposed on a surface "E". In such a case, and in accordance with some embodiments, because no spout 304 or other object is disposed within the extraction socket 330-3, the safety pawls 336 are free to move radially inward, e.g., in reaction to an axially inward biasing force (e.g., supplied by the pawl couplings 336-1 and/or by a spring or other element—not shown), and engage with and stop downward axial movement of the extraction head 372 (and accordingly, the extraction shaft 340). In such a manner, for example, a user is prevented from accidentally compressing the extraction tool 320 on a countertop or other surface "E" (and/or on a body part) and damaging the surface with the piercing element 342—as the piercing element 342 is restrained from advancing to the surface "E" by the action of the safety pawls 336. In such a manner, damage (e.g., dulling, bending, or breaking) to the piercing element 342 due to engagement with a surface "E" may also or alternatively be prevented.

In some embodiments, any or all of the components 302, 302-1, 302-2, 304, 304-1, 306, 306-1, 306-2, 308, 322, 322-1, 324, 324-1, 324-2, 324-3, 326, 326-1, 326-2, 330, 330-1, 330-2, 330-3, 330-4, 330-5, 332, 334, 336, 336-1, 336-2, 336-3, 336-4, 340, 340-1, 342, 342-1, 344, 346, 348, 350, 350-1, 350-2, 350-3, 350-4, 352, 354, 356, 360, 370, 370-1, 370-2, 372, 372-1, 372-2, 374, 374-1, 374-2, 376, 376-1 of the system 300 may be similar in configuration and/or functionality to any similarly named and/or numbered components described herein. Fewer or more components 302, 302-1, 302-2, 304, 304-1, 306, 306-1, 306-2, 308, 322, 322-1, 324, 324-1, 324-2, 324-3, 326, 326-1, 326-2, 330, 330-1, 330-2, 330-3, 330-4, 330-5, 332, 334, 336, 336-1, 336-2, 336-3, 336-4, 340, 340-1, 342, 342-1, 344, 346, 348, 350, 350-1, 350-2, 350-3, 350-4, 352, 354, 356, 360, 370, 370-1, 370-2, 372, 372-1, 372-2, 374, 374-1, 374-2, 376, 376-1 (and/or portions thereof) and/or various configurations of the components 302, 302-1, 302-2, 304, 304-1, 306, 306-1, 306-2, 308, 322, 322-1, 324, 324-1, 324-2, 324-3, 326, 326-1, 326-2, 330, 330-1, 330-2, 330-3, 330-4, 330-5, 332, 334, 336, 336-1, 336-2, 336-3, 336-4, 340, 340-1, 342, 342-1, 344, 346, 348, 350, 350-1, 350-2, 350-3, 350-4, 352, 354, 356, 360, 370, 370-1, 370-2, 372, 372-1, 372-2, 374, 374-1, 374-2, 376, 376-1 may be included in the system 300 without deviating from the scope of embodiments described herein. In some embodiments, one or more of the various components 302, 302-1, 302-2, 304, 304-1, 306, 306-1, 306-2, 308, 322, 322-1, 324, 324-1, 324-2, 324-3, 326, 326-1, 326-2, 330, 330-1, 330-2, 330-3, 330-4, 330-5, 332, 334, 336, 336-1, 336-2, 336-3, 336-4, 340, 340-1, 342, 342-1, 344, 346, 348, 350, 350-1, 350-2, 350-3, 350-4, 352, 354, 356, 360, 370, 370-1, 370-2, 372, 372-1, 372-2, 374, 374-1, 374-2, 376, 376-1 may not be needed and/or desired in the system 300.

While the description of the system 300 includes references to various directions as "upward" or "downward", embodiments are not limited to vertical or horizontal orientations and the terminology is utilized to convey relative orientations. The system 300 depicted in FIG. 3A, for example, is presented in a horizontal-vertical orientation for ease of illustration only. Dispensing surfaces 302-1 of containers (e.g., the container 202 of FIG. 2 herein) are not often oriented horizontally, and accordingly any extraction tool 320 utilized thereon would not be oriented vertically, but would be oriented relative to the dispensing surface 302-1 (e.g., perpendicularly thereto). Similarly, while various times, states, modes, and/or stages of utilization of the extraction tool 320 are depicted and described, the order of times, modes, states, and/or stages is not limited to the order presented.

Figure 4:
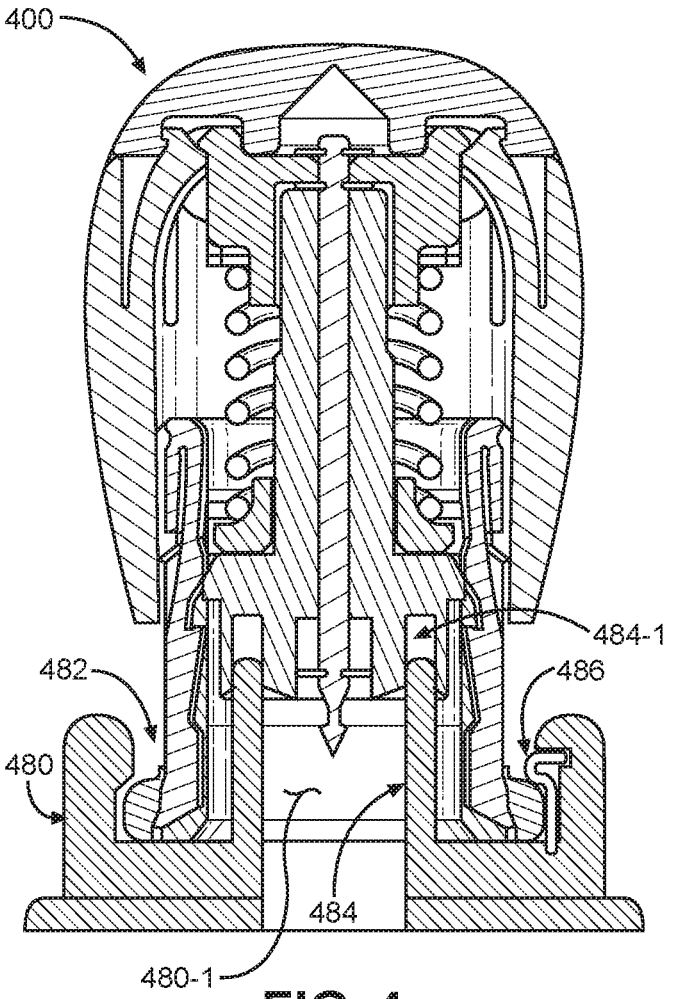
FIG. 4 is a cross-sectional view of a system according to some embodiments.

Turning now to FIG. 4, a cross-sectional view of a system 400 according to some embodiments is shown. In some embodiments, the system 400 as depicted in FIG. 4 may comprise or be similar to the cross-sectional views of the system 300 of FIG. 3B, FIG. 3C, FIG. 3D, FIG. 3E, FIG. 3F, FIG. 3G, and FIG. 3H herein (or portions thereof). The system 400 may comprise, for example, a cross-sectional view of an extraction tool 420 disposed in or on a mounting base 480. The mounting base 480 may comprise and/or define, for example, an interior void 480-1 and/or an extraction tool seat 482.

In some embodiments, the interior void 480-1 may allow a piercing element 442 of the extraction tool 420 to safely reside within the interior void 480-1, without contacting any solid surfaces while the extraction tool 420 is seated in the extraction tool seat 482. In such a manner, for example, the piercing element 442 may be permitted to stay sharp and/or the piercing element 442 may be prevented from doing damage to various surfaces and/or objects (not shown). According to some embodiments, the mounting base 480 may comprise a seal detection collar 484. The seal detection collar 484 may be positioned at a radial diameter such that it is disposed to enter a pull-ring socket 476-1 of the extraction tool 420 in the case that the extraction tool 420 is seated in the extraction tool seat 482 (as depicted). In such a manner, for example, should a container seal (not shown in FIG. 4) be retained by the extraction tool 420 (e.g., resident on the piercing element 442), such as after the extraction tool 420 has been utilized to remove a seal from a container, but without the seal having been removed from the extraction tool 420, the seal detection collar 484 will be prevented from entering the pull-ring socket 476-1 (as it would already be occupied by the seal, a pull-tab, and/or a pull-ring—none of which are shown in FIG. 4). In such an embodiment, the extraction tool 420 may not seat properly in the extraction tool seat 482 and a user (not shown) would accordingly be alerted to the fact that something (e.g., a previously extracted seal) is preventing the proper seating. In some embodiments, the mounting base 480 and/or the extraction tool seat 482 may comprise one or more seat clips 486. The seat clip 486 may comprise a spring element or inwardly biased object, for example, that may be selectively and/or removably engaged to retain a foot 430-3 of the extraction tool 420 in the extraction tool seat 482. In some embodiments, the extraction tool 420 may also or alternatively be retained and/or selectively held in the extraction tool seat 482 utilizing one or more magnets (not shown). According to some embodiments, the mounting base 480 may comprise one or more mounting elements (not shown) such as screw holes, hangers, clips, clamps, and/or magnets. In such a manner, for example, the mounting base 480 may be mounted to a wall, cabinet, countertop, refrigerator, toaster, and/or other convenient surface so that the extraction tool 420 may be safely and easily stored in a convenient location.

According to some embodiments, any or all of the components 420, 430-3, 442, 476-1, 480, 480-1, 482, 484, 486 of the system 400 may be similar in configuration and/or functionality to any similarly named and/or numbered components described herein. Fewer or more components 420, 430-3, 442, 476-1, 480, 480-1, 482, 484, 486 (and/or portions thereof) and/or various configurations of the components 420, 430-3, 442, 476-1, 480, 480-1, 482, 484, 486 may be included in the system 400 without deviating from the scope of embodiments described herein. In some embodiments, one or more of the various components 420, 430-3, 442, 476-1, 480, 480-1, 482, 484, 486 may not be needed and/or desired in the system 400.

IV. Pull-Tab Extraction Tool Apparatus

Figure 5:
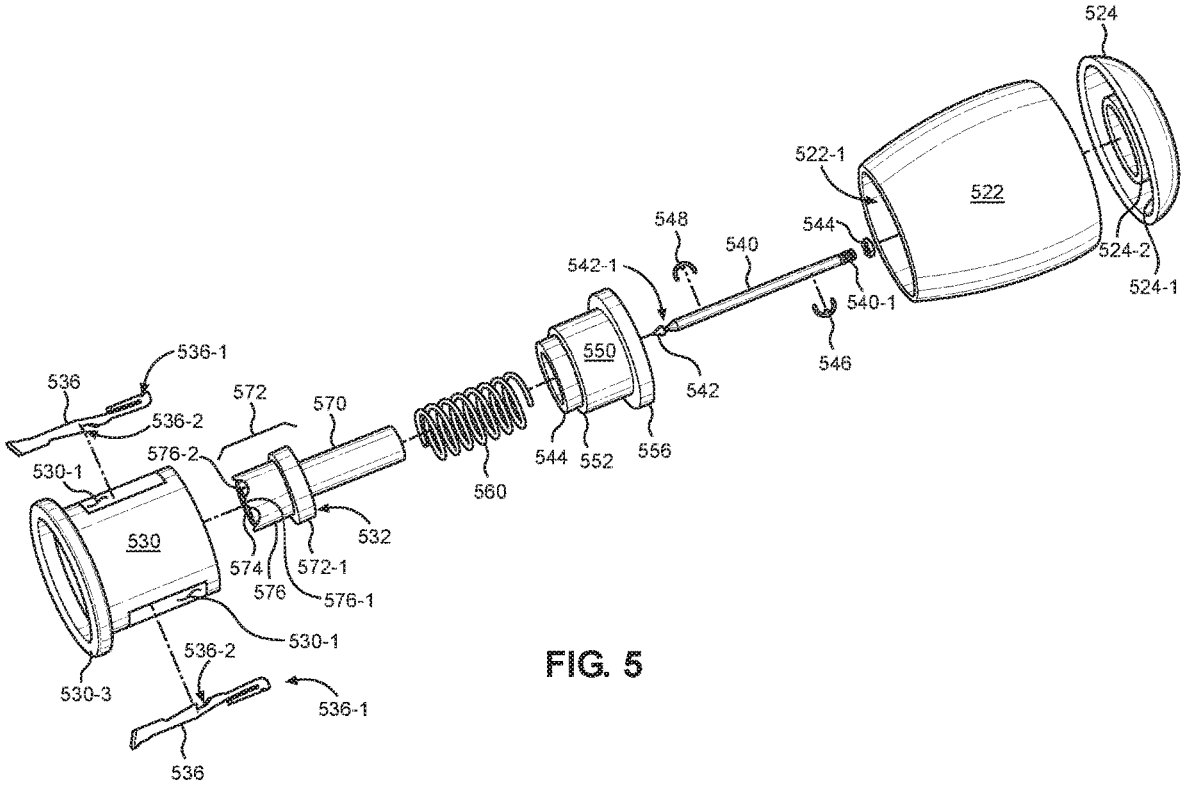
FIG. 5 is a perspective assembly diagram of an apparatus according to some embodiments.

Referring to FIG. 5, a perspective assembly view of a pull-tab extraction tool apparatus 520 according to some embodiments is shown. In some embodiments, the pull-tab extraction tool apparatus 520 may be similar in configuration to the extraction tools 220, 320, 420 of FIG. 2, FIG. 3A, FIG. 3B, FIG. 3C, FIG. 3D, FIG. 3E, FIG. 3F, FIG. 3G, FIG. 3H, and/or FIG. 4 herein (or portions thereof). The pull-tab extraction tool apparatus 520 may comprise, for example, a cover 522 defining an interior volume 522-1 and/or a cap 524 that is removably coupled to the cover 522, e.g., via a cover catch 522-1 (e.g., a flange, tab, and/or key). In some embodiments, the cap 524 may comprise a crown standoff 524-2 (e.g., a flange, tab, and/or key).

According to some embodiments, the pull-tab extraction tool apparatus 520 may comprise a body portion 530 defining and/or comprising one or more pawl slots 530-1 and/or a foot 530-2 (e.g., a radial and/or external flange). In some embodiments, the body portion 530 may comprise and/or define a lower spring seat 532 and/or may comprise and/or be coupled to one or more safety pawls 536. As depicted in FIG. 5, two (2) radially opposed safety pawls 536 may be coupled to and/or disposed in the two (2) radially opposed pawl slots 530-1 of the body portion 530. According to some embodiments, each safety pawl 536 may comprise a pawl coupling 536-1 (and/or biasing element) and/or a safety catch 536-2 (e.g., cutout, detent, or notch).

In some embodiments, the pull-tab extraction tool apparatus 520 may comprise an extraction shaft 540 that comprises shaft threads 540-1 (e.g., end-threads formed on a first end), a piercing element 542 (e.g., formed on a second end), and/or a barb 542-1. According to some embodiments, a shaft nut 544 may be removably coupled to the shaft threads 540-1, an upper shaft clip 546 may be removably coupled to the extraction shaft 540 proximate to the first end, and/or a lower shaft clip 548 may be removably coupled to the extraction shaft 540 proximate to the second end.

According to some embodiments, the pull-tab extraction tool apparatus 520 may comprise a crown 550 that couples the extraction shaft 540 to the cover 522. In some embodiments, the crown 550 may comprise and/or define an upper spring seat 552, a stop surface 554, and/or a retention flange 556. According to some embodiments, the pull-tab extraction tool apparatus 520 may comprise a spring 560 and/or a piston 570. The piston 570 may comprise and/or define, for example, an extraction head 572 comprising a stop lobe 572-1 (e.g., a flange, tab, and/or protrusion), a seal stop 574, and/or a seal gap separator 576.

In some embodiments, the seal gap separator 576 may comprise and/or define one or more separator peaks 576-1 and/or one or more separator valleys 576-2. The engaging edge of the seal gap separator 576 may be scalloped (or undulating), for example, defining one or more separator peaks 576-1 that extend a first distance axially from the extraction head 572 and one or more separator valleys 576-2 that extend a second distance axially from the extraction head 572, wherein the second distance is less that the first distance. While four (4) separator peaks 576-1 are depicted in FIG. 5, fewer or more separator peaks 576-1 may be included in the pull-tab extraction tool apparatus 520, as is or becomes desirable and/or practicable. According to some embodiments, the engaging edge of the seal gap separator 576 may also or alternatively be thinner than other portions of the seal gap separator 576 or tapered.

According to some embodiments, the piston 570 may be sized and/or indexed (e.g., having a square or hexagonally cross-section) to fit within and/or slide into the crown 550. In some embodiments, the extraction shaft 540 may be sized and/or indexed to extend through each of the crown 550 and the piston 570. According to some embodiments, the extraction shaft 540, the crown 550, and/or the piston 570 may comprise one or more rotational action threads or features (not shown) that cause, e.g., the seal gap separator 576 to rotate axially in the case that the crown 550 and the piston 570 are compressed and/or moved axially toward each other—such as during operation of the extraction tool 520 to remove a seal (not shown) as described herein.

The present disclosure provides, to one of ordinary skill in the art, an enabling description of several embodiments and/or inventions. Some of these embodiments and/or inventions may not be claimed in the present application, but may nevertheless be claimed in one or more continuing applications that claim the benefit of priority of the present application. Applicant currently intends to file additional applications to pursue patents for subject matter that has been disclosed and enabled but not claimed in the present application.

What is claimed is:

1. A tool for extracting a seal from a container, comprising:

a body portion comprising a foot at a first end and defining an extraction socket having dimensions that permit the extraction socket to enshroud a spout of the container;

an extraction shaft disposed within the extraction socket, the extraction shaft comprising a piercing element;

a cover coupled to engage with the extraction shaft and being slidably coupled to the body portion and selectively moveable between (i) a first position wherein the extraction shaft is engaged to a retracted position within the extraction socket, and (ii) a second position wherein the extraction shaft is engaged to a seal penetration position within the extraction socket; and a crown coupled to the cover and retaining the extraction shaft at a first end thereof.

2. The tool of claim 1, further comprising:

a piston defining a bore through which the extraction shaft is disposed, the piston being slidably coupled to the crown and the body portion.

3. The tool of claim 2, wherein the piston comprises an extraction head comprising a seal stop collar protruding axially from the extraction head.

4. The tool of claim 3, wherein the extraction head further comprises a seal groove separator protruding axially from the extraction head, and wherein the seal gap separator and the seal stop define a pull-ring socket therebetween.

5. The tool of claim 4, wherein the seal groove separator comprises (i) at least one seal gap separator peak that protrudes axially from the extraction head by a first distance and for at least a first portion of a circumferential perimeter of the extraction head, and (ii) at least one seal gap separator valley that protrudes axially from the extraction head by a second distance and for at least a second portion of the circumferential perimeter of the extraction head, and wherein the second distance is smaller than the first distance.

6. The tool of claim 2, further comprising:

a spring coupled between the crown and the piston.

7. The tool of claim 1, wherein the cover defines a gripping lobe that is at least two inches in diameter.

8. The tool of claim 1, wherein the body portion comprises at least one safety pawl slot, further comprising:

a at least one safety pawl coupled to the boy portion and disposed in the safety pawl slot, the at least one safety pawl comprising a safety catch notch.

9. The tool of claim 8, further comprising:

an extraction head comprising a stop flange coupled to selectively engage with the safety catch notch of the at least one safety pawl.

10. A method for extracting a seal from a container utilizing an ergonomic extraction tool, comprising:

positioning a foot of the extraction tool against a surface of the container such that an extraction socket of the extraction tool is positioned to accept a spout of the container;

compressing the extraction tool axially toward the container by slidably repositioning a cover of the extraction tool from a first disengaged position to a second engaged position, thereby causing a piercing element of an extraction shaft disposed within the extraction socket to pierce the seal inside of the spout;

compressing the extraction tool axially toward the container by slidably repositioning the cover of the extraction tool from the second engaged position to a third engaged position, thereby causing a seal groove separation element disposed within the extraction socket to sever the seal at a seal groove thereof;

rotating the extraction tool, thereby causing the seal groove separation element disposed within the extraction socket to travel along a circumferential length of the seal groove;

disengaging the extraction tool from the container; and removing the seal from the extraction tool.

11. The method of claim 10, wherein the removing of the seal from the extraction tool comprises applying a pulling force to axially dislocate the cover with respect to the extraction socket, thereby retracting a barb of the extraction shaft into a chamber comprising a smaller diameter than the seal.

12. The method of claim 10, wherein the positioning of the foot of the extraction tool against the surface of the container such that the extraction socket of the extraction tool is positioned to accept the spout of the container, causes at least one safety pawl of the extraction tool to be urged radially outward, thereby permitting the compressing that causes the piercing element of the extraction shaft disposed within the extraction socket to pierce the seal inside of the spout.

* * * * *